US009631439B2

(12) United States Patent
Tait

(10) Patent No.: US 9,631,439 B2
(45) Date of Patent: Apr. 25, 2017

(54) GROUND CURRENT DIVERTER

(71) Applicant: Michael J. Tait, Kandiyohi, MN (US)

(72) Inventor: Michael J. Tait, Kandiyohi, MN (US)

( * ) Notice: Subject to any disclaimer, the term of this patent is extended or adjusted under 35 U.S.C. 154(b) by 317 days.

(21) Appl. No.: 14/319,433

(22) Filed: Jun. 30, 2014

(65) Prior Publication Data

US 2015/0380839 A1 Dec. 31, 2015

(51) Int. Cl.
*H01R 4/66* (2006.01)
*E21B 17/02* (2006.01)
*E21B 17/00* (2006.01)

(52) U.S. Cl.
CPC ..... *E21B 17/028* (2013.01); *E21B 17/003* (2013.01); *H01R 4/66* (2013.01)

(58) Field of Classification Search
CPC ..... H01R 4/66; E21B 17/023
See application file for complete search history.

(56) References Cited

U.S. PATENT DOCUMENTS 742,626 A 10/1903 Gilgen
1,460,735 A 7/1923 St. John
1,688,108 A 10/1928 Berger
1,766,587 A * 6/1930 Banner ..... H01R 4/14 174/7
4,743,998 A * 5/1988 Wu ..... H02H 3/16 174/6
5,832,179 A 11/1998 Kim et al.
6,135,359 A 10/2000 Almasy et al.
9,248,270 B2 * 2/2016 Karmarkar ..... A61N 1/05
2005/0155782 A1 * 7/2005 Westberry ..... H05K 13/0408 174/51
2006/0126259 A1 * 6/2006 Stockin ..... H01R 4/66 361/212
2008/0173461 A1 * 7/2008 Stockin ..... H01R 4/66 174/6
2008/0217041 A1 * 9/2008 Kim ..... H01B 7/16 174/6
2010/0224385 A1 * 9/2010 Gordin ..... H01R 4/66 174/6
2012/0168195 A1 * 7/2012 Gordin ..... H01R 4/66 174/6
2013/0193045 A1 8/2013 Vreeland

OTHER PUBLICATIONS

Luke Hebert, Alcohol, The Engineer's and Mechanic's Encyclopedia, 1837, pp. 59-62, vol. 1, Thomas Kelly, London.
Gail Damerow, Fences for Pasture and Garden, 1992, p. 84, Storey Publishing, North Adams, MA.
Reditek Corporation Product Catalog, Pompano Beach, Florida.

* cited by examiner

*Primary Examiner* — Blake Michener
*Assistant Examiner* — Manuel C Portocarrero
(74) *Attorney, Agent, or Firm* — Vidas Arrett & Steinkraus

(57) ABSTRACT

A device which can be used on a water pipe has a first metallic, tubular section and a second metallic, tubular section. The first and second metallic, tubular sections are separated from one another by an electrically non-conductive section. The device also has a first metallic wire that extends through the tubular wall of the first metallic, tubular section in at least five locations and further extends across the first interior three times. The first metallic wire is electrically coupled to the second metallic, tubular section.

19 Claims, 2 Drawing Sheets

GROUND CURRENT DIVERTER

CROSS-REFERENCE TO RELATED APPLICATIONS

None.

STATEMENT REGARDING FEDERALLY SPONSORED RESEARCH

Not Applicable.

BACKGROUND OF THE INVENTION

In the farming and ranching industry, stray voltage can cause a variety of problems for caretakers and animals alike. In particular, stray voltage can cause behavior changes in livestock; the livestock can become erratic and/or shifty. Further, where stray voltage interacts with a water supply, the livestock can be less inclined to drink, resulting in decreased productivity and possibly even death of the animal. The impact of stray voltage in a water supply may be particularly acute in dairy operations because dairy cows require a lot of water to maintain the desired level of milk production.

Stray voltage can be introduced into an animal's environment in a variety of ways, for example by bad grounding, improper wire sizing, poor shielding in electric motors (e.g., induced currents), and in other ways. Depending on the environment and the source of the stray voltage, the impact on a water supply, for example a well water supply, can be significant.

Therefore, there remains a need for a device to reduce or eliminate stray voltage in a water supply. Moreover, there remains a need for a device to reduce or eliminate stray voltage in a livestock water supply originating from a well having an electric motor (e.g., submersible pump).

Without limiting the scope of the invention, a brief summary of some of the claimed embodiments is set forth below. Additional details of the summarized embodiments and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a device comprises a first metallic, tubular section; a second metallic, tubular section; a section of electrically non-conductive tube; and a first metallic wire. The first metallic, tubular section comprises a tubular wall and defines a first interior. The section of electrically non-conductive tube separates the first metallic, tubular section from the second metallic. And, the first metallic wire extends through the tubular wall of the first metallic, tubular section in at least five locations and further extends across the first interior three times, wherein the first metallic wire is electrically coupled to the second metallic, tubular section.

DETAILED DESCRIPTION OF THE INVENTION

Figure 1:
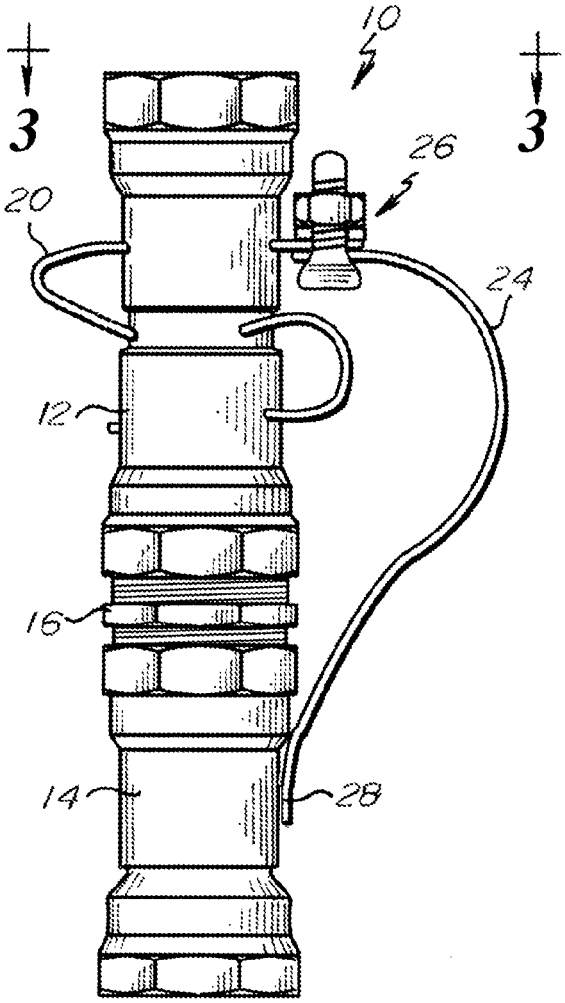
FIG. 1 is a side view of an embodiment of a device 10.
Figure 2:
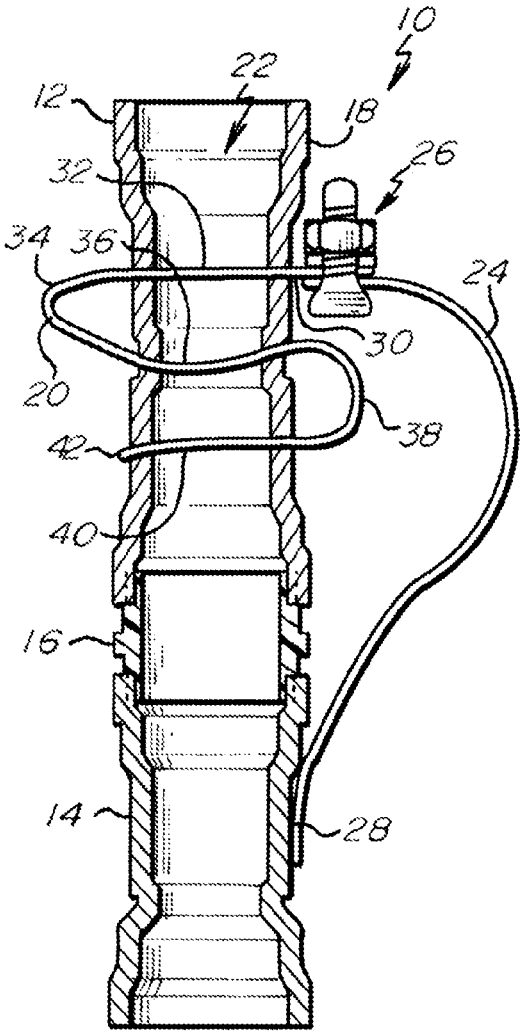
FIG. 2 is a cutaway view of the embodiment of the device of FIG. 1.

In some embodiments, for example as shown in FIG. 1, a device 10 includes a first metallic, tubular section 12 and a second metallic, tubular section 14. The first metallic, tubular section 12 is separated from the second metallic, tubular section 14 with a non-conductive tubular section 16. In some embodiments, the first metallic, tubular section 12 is formed from one or more pieces of tubing, piping, and/or tubular fittings, made of, for example, copper or a copper alloy. As shown in FIG. 2, the first metallic, tubular section 12 has a tubular wall 18.

Further, the second metallic, tubular section 14 can be formed from one or more pieces of tubing, piping, and/or tubular fittings, for example made of, for example, copper or a copper alloy. Where more than one piece of tubing, piping, and/or other fittings are used to form the respective metallic, tubular section, the pieces can be attached to one another in any suitable fashion, for example soldering, welding, or threading or any other suitable fashion.

In some embodiments, the non-conductive tubular section 16 is formed from one or more fittings, pieces of tubing or piping. For example, the non-conductive tubular section 16 can comprise a fitting formed from a polymeric material such as polyvinyl chloride (PVC). Other non-conducting materials can also be used, for example cross-linked polyethylene (PEX), chlorinated polyvinyl chloride (CPVC), high-density polyethylene (HDPE), and any other suitable material or composition of materials.

The non-conductive tubular section 16 can be fitted, screwed to, or otherwise attached to the first metallic, tubular section 12 and second metallic, tubular section 14 in any suitable fashion. In some embodiments, the non-conductive tubular section 16 comprises a pipe fitting with male threads that thread into the first metallic, tubular section 12 and second metallic, tubular section 14.

In at least some embodiments, the device 10 further includes a first metallic wire 20. The first metallic wire 20 extends through the tubular wall 18 of the first metallic, tubular section 12. In some embodiments, the first metallic wire 20 extends through the tubular wall 18 in more than one location. For example, in some embodiments, the first metallic wire 20 extends through the tubular wall 18 of the first metallic, tubular section 12 in at least five separate locations. As illustrated in FIG. 2, for example, the first metallic wire 20 extends through the tubular wall 18 at six separate locations. At one or more of the locations where the first metallic wire 20 extends through the tubular wall 18, the first metallic wire 20 is attached to the tubular wall 18. The first metallic wire 20 can be attached to the tubular wall 18 in any suitable way, for example by soldering, welding, brazing, electrically conductive adhesive, or any other suitable method or mechanism that transmits electrical current. The first metallic wire 20 can be formed from any suitable material, for example copper or an alloy of copper As further illustrated in FIG. 2, the first metallic, tubular section 12 defines a first interior 22. In at least some embodiments, the first metallic wire 20 extends across the first interior 22, for example as shown in FIG. 2. In some embodiments, the first metallic wire 20 extends across the first interior 22 at least twice and, in some embodiments, at least three times.

In at least some embodiments, the device 10 further comprises a second metallic wire 24. The second metallic wire 24 is attached to the second metallic, tubular section 14, as shown at 28. In some embodiments, the second metallic wire 24 is coupled to the second metallic, tubular section 14 by soldering; welding, brazing, electrically conductive adhesive, or any other suitable method or mechanism that transmits electrical current. The second metallic wire 24 can be formed from any suitable material, for example copper or an alloy of copper.

In some embodiments, the second metallic wire 24 is coupled to the first metallic wire 20. The first and second metallic wires 20, 24 can be coupled together in any suitable fashion, for example via a fastener 26 (as shown in FIGS. 1 and 2), via soldering, welding, electrically conductive adhesive or any other suitable method or mechanism that transmits electrical current. In some embodiments, the fastener 26 is a split bolt and nut which can be used to clamp the first and second metallic wires 20, 24 together. In some embodiments, a bronze split bolt with spacer from Reditek is used.

In some embodiments, the first metallic, tubular section 12 and second metallic, tubular section 14 are formed of the same metal. In some embodiments, the first metallic, tubular section 12 and the first metallic wire 20 are formed of the same metal. In some embodiments, the second metallic, tubular section 14 and the second metallic wire 24 are formed of the same metal. In some embodiments, the first and second metallic wires are formed of the same metal. In some embodiments, the first and second metallic, tubular sections and the first and second metallic wire are formed of the same metal.

In some embodiments, the first metallic wire 20 is at least 1/16" in diameter; in some embodiments, the second metallic wire 24 is at least 1/16" in diameter. In some embodiments, both the first metallic wire and second metallic wire are at least 1/16" in diameter.

Figure 3:
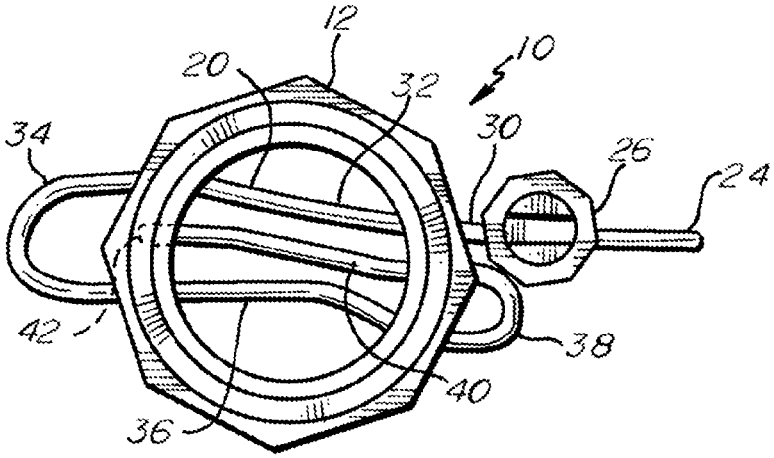
FIG. 3 is a top view of the embodiment of the device of FIG. 1.

Turning to FIG. 3, a top view of an embodiment of the device 10 is shown. As illustrated, in some embodiments, the first metallic, tubular section 12 comprises a plumbing fitting for attachment to a water pipe. In some embodiments, the first metallic wire 20 comprises a plurality of portions, for example a first portion 30, second portion 32, third portion 34, fourth portion 36, fifth portion 38, sixth portion 40, and seventh portion 42.

With further regard to FIG. 3, in some embodiments, the second portion 32 is laterally spaced apart from the fourth portion 36. Further, in some embodiments, the fourth portion 36 is laterally spaced apart from the sixth portion 40. As shown in FIG. 2, in some embodiments, the second portion 32 is spaced apart from the fourth portion 36 along the length of the first metallic, tubular section 12. As also shown, in some embodiments, the second portion 32 is spaced apart from the sixth portion 40 along the length of the first metallic, tubular section 12.

In some embodiments, the first metallic wire 20 is soldered to the tubular wall 18 at one or more of the locations where the first metallic wire 20 intersects or crosses the tubular wall 18. In some embodiments, the first metallic wire 20 is soldered to the tubular wall 18 at all of the locations where the first metallic wire 20 intersects or crosses the tubular wall 18

Figure 4:
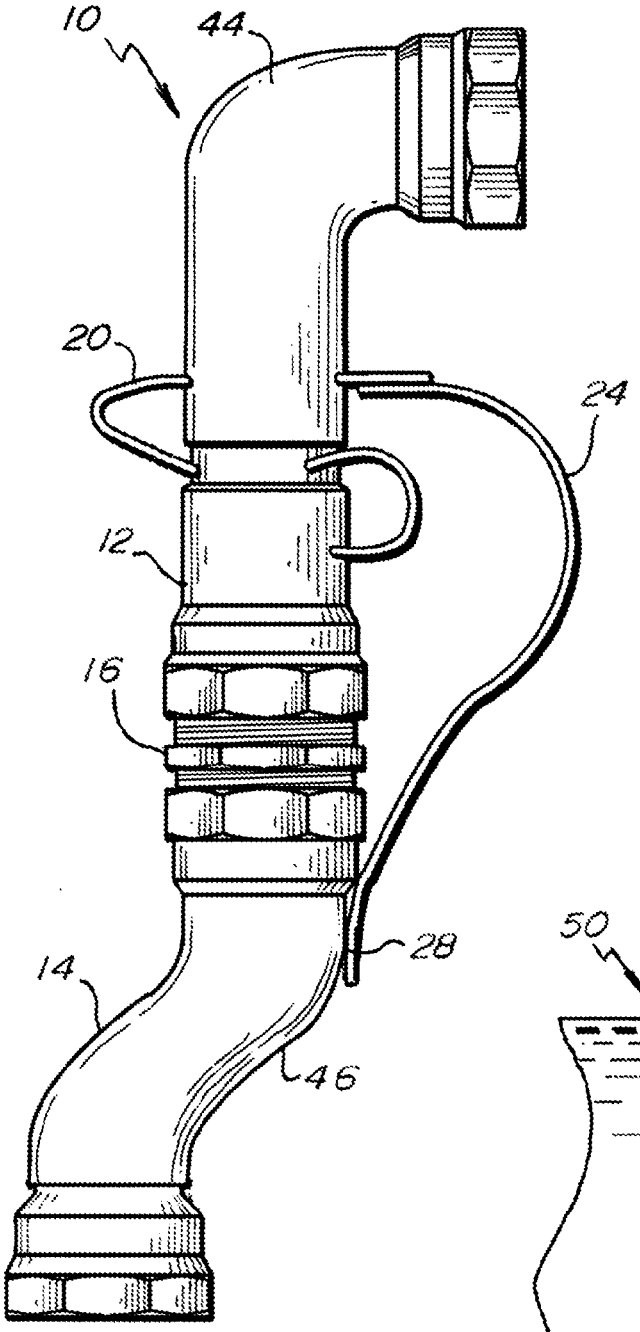
FIG. 4 is a side view of an embodiment of a device 10.

In some embodiments, for example as shown in FIG. 4, the first metallic, tubular section 12 has at least a first curved portion 44. Further, in some embodiments, the second metallic, tubular section 14 has at least a second curved portion 46. The first metallic, tubular section 12 and second metallic, tubular section 14 can take on any desired shape or configuration.

In some embodiments, the device 10 is used in conjunction with a well pipe or other water pipe. For example, in some embodiments, the device 10 may be added to a livestock watering assembly in an effort to reduce or eliminate stray voltage. Further, it has been observed in dairy cattle that upon introduction of an embodiment of the device 10, for example the embodiment shown in FIG. 2, into a livestock watering assembly, consumption of water by dairy cattle increased as did milk production. It is believed the water consumption by dairy cattle may increase by up to 40% or more and milk production of the dairy cattle may increase by up to 10% or more when compared to the milk production prior to the addition of the device 10. Additionally, it is believed that water consumption by cattle increased while feed consumption decreased by 10-40%.

In some embodiments, the device 10 is used in conjunction with oil, for example, on an oil well. Oil, such as crude oil, extracted from a well can be ionized and may have a negative or positive charge. Some embodiments of the device 10 can be used in conjunction with a well to deionize ionized particles in the oil.

Figure 5:
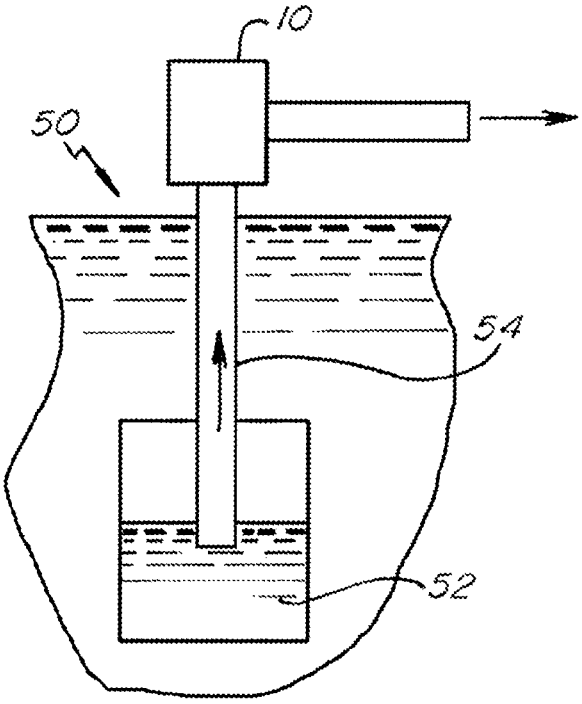
FIG. 5 shows an embodiment of a well system 50.

As shown in FIG. 5, the device 10 is schematically illustrated in a well system 50. The well system 50 extracts fluid 52 from the ground via well pipe 54; the fluid 52 moves in the direction of the arrows, as illustrated. In some embodiments, the well system 50 includes a pump (not shown) or other mechanism to force the fluid 52 out of the ground. The fluid 52 can include water, oil, gas, or any combination of fluids. In at least some embodiments, the device 10 is located in a pressurized portion of the well system 50. In some embodiments, the particular arrangement or placement of the device 10 within the pressurized portion of the well system 50 is immaterial.

The device 10 may also be used in conjunction with fluids that are pumped or delivered from sources other than the ground. For example, the device 10 can be used in conjunction with a pump which is used to pump fluid from a tank. The fluid may be flammable or non-flammable. The inventive devices may, optionally, be included in a pressurized portion of the system. For example, the device may be incorporated into a pump system for pumping gas from a tank or sewage from a septic tank.

To that end, some embodiments are also directed to a tank, a pump in fluid communication with the tank and any of the devices set forth in this disclosure incorporated into piping leading from the tank to the pump or from piping leading from the pump to an opening from which the fluid may emanate.

The invention is also directed to the following devices, as set forth in the numbered statements below:

1. A device comprising:

a first metallic, tubular section comprising a tubular wall and defining a first interior;

a second metallic, tubular section;

a section of electrically non-conductive tube separating the first metallic, tubular section from the second metallic, tubular section; and a first metallic wire, the first metallic wire extending through the tubular wall of the first metallic, tubular section in at least five locations and extending across the first interior three times, wherein the first metallic wire is electrically coupled to the second metallic, tubular section.

2. The device of statement 1, wherein the first metallic wire is copper or an alloy of copper.

3. The device of any one of statements 1 and 2, wherein the first metallic, tubular section is copper or an alloy of copper.

4. The device of any one of statements 1-3, wherein the second metallic, tubular section is copper or an alloy of copper.

5. The device of any one of statements 1-4, wherein the first metallic wire and the first metallic, tubular section are formed of the same metal.

6. The device of any one of statements 1-5, wherein the first metallic wire and the second metallic, tubular section are formed of the same metal.

7. The device of any one of statements 1-6, wherein the section of electrically non-conductive tube is formed of polyvinyl chloride.

8. The device of any one of statements 1-7, wherein the first metallic wire is soldered to the wall of the first metallic, tubular section.

9. The device of any one of statements 1-8, wherein the first metallic wire is at least 1/16" in diameter.

10. The device of any one of statements 1-9, wherein the second metallic, tubular section comprises a curved portion.

11. The device of any one of statements 1-10, wherein the first metallic, tubular section comprises a curved portion.

12. The device of any one of statements 1-11, wherein the first metallic wire comprises a first portion and a second portion, the first portion defined by a portion of the first metallic wire extending across the first interior and the second portion defined by anther portion of the first metallic wire extending across the first interior, wherein the first and second portions are spaced apart from one another along the length of the first metallic, tubular section.

13. The device of any one of statements 1-12, further comprising a second metallic wire, the second metallic wire in electrical communication with the second metallic, tubular section and in electrical communication with the first metallic wire.

14. The device of any one of statements 1-12, further comprising a second metallic wire, the second metallic wire soldered to the second metallic, tubular section and electrically coupled to the first metallic wire.

15. A device comprising:

a first metallic, tubular section having a sidewall defining a first interior;

a second metallic, tubular section;

a section of electrically insulative tube separating the first metallic tubular section from the second tubular metallic section; and a metallic wire, the metallic wire extending through the sidewall in one or more locations and in the first interior, the metallic wire attached to the second metallic, tubular section.

16. A well having a source of fluid, the source of fluid in fluid communication with the device of any one of the previous statements.

17. The well of statement 16 wherein the source of fluid comprises water.

18. The well of statement 16 wherein the source of fluid comprises gas.

19. The well of statement 16 wherein the source of fluid comprises oil.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments. Those skilled in the art may recognize other equivalents to the specific embodiment described herein which equivalents are intended to be encompassed by the claims attached hereto.

What is claimed is:

1. A device comprising:

a first metallic, tubular section comprising a tubular wall and defining a first interior;

a second metallic, tubular section;

a section of electrically non-conductive tube separating the first metallic, tubular section from the second metallic, tubular section; and a first metallic wire, the first metallic wire extending through the tubular wall of the first metallic, tubular section in at least five locations and extending across the first interior three times, wherein the first metallic wire is electrically coupled to the second metallic, tubular section.

2. The device of claim 1, wherein the first metallic wire is copper or an alloy of copper.

3. The device of claim 1, wherein the first metallic, tubular section is copper or an alloy of copper.

4. The device of claim 1, wherein the second metallic, tubular section is copper or an alloy of copper.

5. The device of claim 1, wherein the first metallic wire and the first metallic, tubular section are formed of the same metal.

6. The device of claim 1, wherein the first metallic wire and the second metallic, tubular section are formed of the same metal.

7. The device of claim 1, wherein the section of electrically non-conductive tube is formed of polyvinyl chloride.

8. The device of claim 1, wherein the first metallic wire is soldered to the wall of the first metallic, tubular section.

9. The device of claim 1, wherein the first metallic wire is 1/16" in diameter.

10. The device of claim 1, wherein the second metallic, tubular section comprises a curved portion.

11. The device of claim 1, wherein the first metallic, tubular section comprises a curved portion.

12. The device of claim 1, wherein the first metallic wire comprises a first portion and a second portion, the first portion defined by a portion of the first metallic wire extending across the first interior and the second portion defined by another portion of the first metallic wire extending across the first interior, wherein the first and second portions are spaced apart from one another along the length of the first metallic, tubular section.

13. The device of claim 1 further comprising a second metallic wire, the second metallic wire in electrical communication with the second metallic, tubular section and in electrical communication with the first metallic wire.

14. The device of claim 1 further comprising a second metallic wire, the second metallic wire soldered to the second metallic, tubular section and electrically coupled to the first metallic wire.

15. A device comprising:

a first metallic, tubular section having a sidewall defining a first interior;

a second metallic, tubular section;

a section of electrically insulative tube separating the first metallic tubular section from the second tubular metallic section; and a metallic wire, the metallic wire extending through the sidewall in one or more locations and in the first interior, the metallic wire attached to the second metallic, tubular section.

16. A well having a source of fluid, the source of fluid in fluid communication with a device comprising:

a first metallic, tubular section having a sidewall defining a first interior;

a second metallic, tubular section;

a section of electrically insulative tube separating the first metallic tubular section from the second tubular metallic section; and a metallic wire, the metallic wire extending through the sidewall in one or more locations and in the first interior, the metallic wire attached to the second metallic, tubular section.

17. The well of claim 16 wherein the source of fluid comprises water.

18. The well of claim 16 wherein the source of fluid comprises gas.

19. The well of claim 16 wherein the source of fluid comprises oil.

* * * * *